US009408506B2

(12) United States Patent
Hjort et al.

(10) Patent No.: US 9,408,506 B2
(45) Date of Patent: Aug. 9, 2016

(54) DISPENSING UNIT AND DISPENSER

(75) Inventors: Erik Hjort, Borlänge (SE); Matti Karonen, Vikmanshyttan (SE); Marcus Kullman, Borlänge (SE); Stig Pommer, Borlänge (SE); Sylvia Jonsson, Göteborg (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 1 day.

(21) Appl. No.: 14/411,145

(22) PCT Filed: Jun. 28, 2012

(86) PCT No.: PCT/SE2012/050734

§ 371 (c)(1),
(2), (4) Date: Dec. 24, 2014

(87) PCT Pub. No.: WO2014/003618

PCT Pub. Date: Jan. 3, 2014

(65) Prior Publication Data

US 2015/0335211 A1 Nov. 26, 2015

(51) Int. Cl.
*A47K 10/38* (2006.01)
*B65H 16/02* (2006.01)
(Continued)

(52) U.S. Cl.
CPC ..... *A47K 10/34* (2013.01); *A47K 10/3643* (2013.01); *A47K 10/3818* (2013.01); *B65H 20/02* (2013.01)

(58) Field of Classification Search
CPC ... A47K 10/24; A47K 10/38; A47K 10/3818; B65H 23/10; Y10T 225/21; Y10T 225/206; Y10T 225/213
USPC ..... 242/593, 564, 564.1, 565, 615.3
See application file for complete search history.

(56) References Cited

U.S. PATENT DOCUMENTS 469,607 A * 2/1892 Stevenson ..... B65H 39/16 225/23
535,335 A * 3/1895 Hoyt ..... 242/328.2
1,154,632 A * 9/1915 Hoberg ..... 225/106
(Continued)

FOREIGN PATENT DOCUMENTS

WO WO 2010/120399 A1 10/2010
WO WO 2012/003867 A1 1/2012

OTHER PUBLICATIONS

International Search Report (PCT/ISA/210) mailed on Feb. 21, 2013, by the Swedish Patent Office as the International Searching Authority for International Application No. PCT/SE2012/050734.
(Continued)

*Primary Examiner* — William A Rivera
(74) *Attorney, Agent, or Firm* — Buchanan Ingersoll & Rooney PC

(57) ABSTRACT

A dispensing unit and a dispenser are provided. The dispenser is adapted for the use with continuous web material. The dispensing unit includes a first roller arranged to rotate about a first axis and a second roller arranged to rotate about a second axis. A web path is provided through the dispensing unit and a portion of the web path consists of a web passage defined between the first roller and the second roller. A drive mechanism engages with at least one of the first roller and the second roller for feeding web material through the web passage. The drive mechanism comprises a feeding ring rotatably suspended in the dispensing unit. The feeding ring extends around the web path.

17 Claims, 6 Drawing Sheets

(51) Int. Cl.

| | |
|---|---|
| ***B65H 26/00*** | (2006.01) |
| ***A47K 10/34*** | (2006.01) |
| ***B65H 20/02*** | (2006.01) |
| ***A47K 10/36*** | (2006.01) |

(56) References Cited

U.S. PATENT DOCUMENTS

| | | | | |
|---|---|---|---|---|
| 4,432,482 | A * | 2/1984 | Beausoleil | A47K 10/36 225/46 |
| 5,454,500 | A * | 10/1995 | Chen | A47K 10/38 206/403 |
| 5,577,634 | A | 11/1996 | Morand | |
| 6,089,401 | A | 7/2000 | Salaker | |
| 2003/0066924 | A1 | 4/2003 | Widlund | |
| 2003/0111480 | A1 | 6/2003 | Lewis et al. | |
| 2010/0258579 | A1 | 10/2010 | Billman et al. | |

OTHER PUBLICATIONS

Written Opinion (PCT/ISA/237) mailed on Feb. 21, 2013, by the Swedish Patent Office as the International Searching Authority for International Application No. PCT/SE2012/050734.

* cited by examiner

DISPENSING UNIT AND DISPENSER

TECHNICAL FIELD

The present disclosure relates to a dispensing unit and a dispenser for a continuous web material.

BACKGROUND

Dispensers for continuous web material such as tissue paper or non-woven material are well known. Such a dispenser may be used with perforated and non-perforated web material. A user dispensing a sheet of web material from the dispenser grasps and pulls on a tail of web material extending from the dispenser. Perforated web material is designed to break at the perforations when the user pulls on the tail. The dispenser may be designed to provide a suitable amount of friction against the web material in order for the perforation to break. Dispensers used in conjunction with non-perforated web material may be provided with an edge, against which a user may tear the web material to separate a sheet of web material from web material remaining in the dispenser. In some situations the tail of web material may end inside the dispenser making it difficult, or impossible, for a user to grasp the tail in order to dispense web material from the dispenser.

WO 2010/120399 discloses a braking assembly used in a dispenser that dispenses a continuous supply of material such as paper. A first gear and a second gear are rotatably connected to a support structure of the braking assembly. Teeth of the first gear and teeth of the second gear intermesh with each other and allow the paper to pass therethrough. A manual feed knob allows a user to advance the paper if a perforation of the paper breaks within the gears and there is no tail left showing for the next portion of paper. The manual feed knob may also be used to ease loading of a leading end of a fresh roll of paper through the braking assembly. The manual feed knob may be difficult for a user to operate since it may be difficult to locate.

SUMMARY

An object of the present disclosure is to provide an easily accessible and operable arrangement for advancing web material from a dispenser.

According to an aspect of the present disclosure, the object is achieved by a dispensing unit for a dispenser being adapted for the use with continuous web material. The dispensing unit comprises a first roller arranged to rotate about a first axis and a second roller arranged to rotate about a second axis. The first and second axes are substantially parallel. A web path is provided through the dispensing unit and a portion of the web path consists of a web passage defined between the first roller and the second roller. A drive mechanism engages with at least one of the first roller and the second roller for feeding web material through the web passage. The drive mechanism comprises a feeding ring rotatably suspended in the dispensing unit, the feeding ring extending around the web path.

Since the feeding ring extends around the web path, a large diameter feeding ring is accommodated in a dispensing unit. Such a feeding ring is readily accessible and easily operable for a user to advance web material from a relevant dispenser. As a result, the above mentioned object is achieved.

The dispensing unit may be integrated in a dispenser for continuous web material. In particular, various parts or portions of the dispensing unit may form part of the dispenser. Alternatively, the dispensing unit may form a separate unit, which is connected to a dispenser for continuous web material. The dispensing unit may be connected to a dispenser, e.g.

at a lower end of a dispenser or at a front end of a dispenser. The dispenser may be suspended from a supporting structure, such as a wall, or it may form a free standing device. The feeding ring may be rotatably supported in a seat, which seat is provided in the dispensing unit, e.g. a wall portion of the dispensing unit.

According to embodiments, the feeding ring may be arranged to rotate about a third axis, the third axis extending substantially perpendicularly to the first axis and the second axis.

According to embodiments, an outer circumferential surface of the feeding ring forms an outer surface portion of the dispensing unit. In this manner the feeding ring may be reachable for a user from an outside of the dispensing unit.

According to embodiments, the dispensing unit may comprise a circular cylindrical portion and the feeding ring may form at least part of the circular cylindrical portion. In this manner the feeding ring may be reachable for a user from an outside of the dispensing unit.

According to embodiments, the feeding ring may be arranged to be manually actuated.

According to embodiments, the drive mechanism may engage with the first roller. In this manner a rotation of the feeding ring is translated into a rotation of the first roller. The feeding ring may engage directly with the first roller. Alternatively, the drive mechanism may comprise further components, which may be arranged between the feeding ring and the first roller.

According to embodiments, a one-way bearing may be arranged between a drive shaft of the drive mechanism and the first roller. In this manner a rotation of the feeding ring, in a direction which advances web material from a relevant dispenser, is transferred to the first roller, and/or the second roller. However, a rotation of the first roller, and/or the second roller, caused by web material being dispensed along the web path, is not transferred to the feeding ring. Thus the feeding ring does not rotate during dispensing of web material, and unnecessary noise from an otherwise rotating feeding ring may be avoided.

According to embodiments, the drive mechanism may comprise a transmission arranged between the feeding ring and the first roller. The transmission may comprise for instance one or more cog wheels.

According to embodiments, the transmission may comprise a first gearing. In this manner a gear ration may be introduced between the feeding ring and the first roller.

According to embodiments, a second gearing may be connected to the first roller and the second roller to transfer a rotation from the first roller to the second roller. In this manner both the first roller and the second roller may be rotated by the feeding ring.

According to embodiments, the first roller may be suspended in a cradle. The cradle may be movably arranged in the dispensing unit to displace the first roller from a first position to a second position. The first position may be closer to the second roller than the second position. The cradle may be suspended in the dispensing unit, e.g. in a wall portion of the dispensing unit. In the first position of the first roller, the first and second rollers may so close to each other that web material extending in the web passage may abut against both the first and the second roller. In the first position of the first roller, portions of the first and second rollers may overlap, seen in a direction along the first and second axes.

In the first position of the first roller, the first and second rollers may both be positioned to abut against the continuous web material in the web passage during dispensing of portions of the continuous web material. At least when the first roller is in the first position, the first and second rollers may be rotated by the web material as it is being dispensed by a user from the dispenser. The web material thus frictionally engages with the first and second rollers. The frictional engagement between the web material and the first and second rollers ensures that the web material breaks at a perforation as a user pulls on the web material to dispense, and separate, a sheet of web material from the roll of continuous web material. Thus, in the first position of the first roller the dispensing unit may be set for dispensing of perforated web material.

In the second position of the first roller, the web material is subjected to less or no frictional forces from the first and second rollers. As mentioned above, in the first position of the first roller, portions of the first and second rollers may overlap and thus, form an undulated web passage. In the second position of the first roller on the other hand, the first and second rollers may be positioned such that only one, or none, of the first and second rollers abuts against the continuous web material in the web passage during dispensing of portions of the continuous web material.

The distances between the first and second rollers are herein defined in a static state when no dispensing takes place, i.e. at least the second roller may be movable during dispensing of web material. The second roller may for instance be suspended in a second cradle, which may be biased towards the first roller by a resilient element. That is, when first roller is in the first position, the second cradle may be displaced in a direction away from the first roller against the biasing force of the resilient element, during dispensing of web material.

According to embodiments, the first roller and/or the second roller may comprise disc-shaped elements arranged at a distance from each other along the first axis of the first roller and/or the second axis of the second roller.

When the first roller is in the first position, the disc-shaped elements of the first roller may overlap the disc-shaped elements of the second roller to form an undulated web passage between the first and second rollers. In this manner it may be ensured that perforated web material thoroughly engages with the first and second rollers. The first and second rollers define between themselves a web passage forming a nip, in which frictional forces between the first and second rollers on the one hand and the web material on the other hand allow a user to separate a sheet of web material along its perforation from a roll of continuous web material.

Put differently, the disc-shaped elements form large diameter longitudinal sections of the first and second rollers, between which small longitudinal diameter sections are arranged. The first roller and the second roller may be arranged such that a small diameter longitudinal section of the first roller is opposite to a large diameter longitudinal section of the second roller and a large diameter longitudinal section of the first roller may be opposite to a small diameter longitudinal section of the second roller, when the first roller is in the first position. The first roller and the second roller may be arranged at a distance from each other such that the web passage defined between the first and second rollers is undulated.

According to embodiments, at least one of the disc-shaped elements, seen in a circumferential direction, may comprise narrow portions and wide portions. In this manner the at least one disc-shaped element may form a cog wheel having axial cogs which may further improve a frictional engagement between the first and second rollers and the web material during dispensing. Furthermore, at least one disc-shaped element of each of the first and second rollers may comprise narrow and wide portions. In this manner the axial cogs of the disc-shaped elements of each roller may define part of the web passage.

According to embodiments, the first roller and the second roller may comprise disc-shaped elements. The disc-shaped elements of the first and second rollers may overlap each other 1.5-6 mm in the first position of the first roller. In the second position of the first roller, the disc-shaped elements of the first and second rollers may not overlap each other.

According to a further aspect of the present disclosure, the above-mentioned object is achieved by a dispenser comprising a housing adapted to receive and support a roll of continuous web material, wherein the housing has a dispensing end. The dispenser comprises a dispensing unit according to any one of aspects and/or embodiments discussed above attached to the housing at the dispensing end of the housing. The web path extends from the dispensing end of the housing and through the dispensing unit.

According to embodiments, the housing may be adapted to receive a centre feed roll of continuous web material.

Further features and advantages will become apparent when studying the appended claims and the following detailed description. Those skilled in the art will realize that different features of the present disclosure may be combined to create embodiments other than those described in the following, without departing from the scope of the present disclosure, as defined by the appended claims.

BRIEF DESCRIPTION OF THE DRAWINGS

The various aspects of the present disclosure, including its particular features and advantages, will be readily understood from the following detailed description and the accompanying drawings, in which.

DETAILED DESCRIPTION

The present disclosure will now be described more fully with reference to the accompanying drawings, in which example embodiments are shown. However, the present disclosure should not be construed as limited to the embodiments set forth herein. Disclosed features of example embodiments may be combined as readily understood by one of ordinary skill in the art. Like numbers refer to like elements throughout. Well-known functions or constructions will not necessarily be described in detail for brevity and/or clarity.

Figure 1:
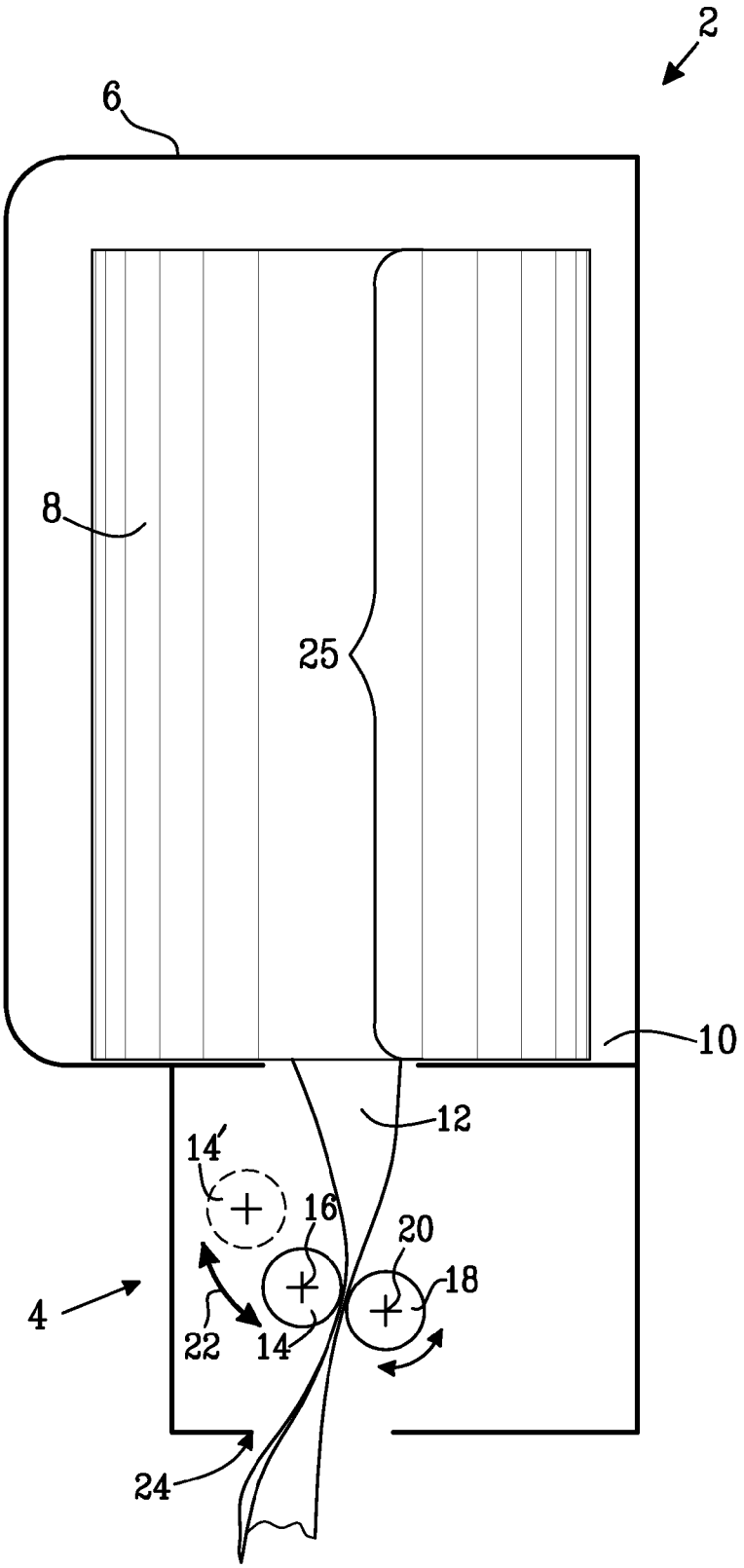
FIG. 1 illustrates schematically a cross section through a dispenser and a dispensing unit according to embodiments.

FIG. 1 illustrates schematically a cross section through a dispenser 2 and a dispensing unit 4 according to embodiments. The dispenser 2 comprises a housing 6 adapted to receive and support a roll 8 of continuous web material. The housing 6 may be opened for replenishing the dispenser 2 with rolls of continuous web material. The housing 6 has a dispensing end 10. In its broadest interpretation the dispensing end 10 is simply a portion of the housing 6, where a tail 12 of the continuous web material parts from the roll 8. The dispenser 2 comprises the dispensing unit 4, which is arranged at the dispensing end 10 of the housing 6. This encompasses the dispensing unit 4 forming an integral part of the dispenser 2 as well as the dispensing unit 4 forming a separate part of the dispenser 2. Such a separate part may be either permanently or removably attached to the housing 6 of the dispenser 2. The dispensing unit 4 is provided for separating a sheet of web material from the tail 12 of continuous web material. The housing 6 is adapted to receive a centre feed roll 8 of continuous web material. However, the dispensing unit 4 may also be used in connection with peripheral feed rolls of continuous web material, in which case the housing of the dispenser is adapted to receive such a roll of continuous web material and to provide a dispensing end at the dispensing unit 4.

The dispensing unit 4 comprises a first roller 14 arranged to rotate about a first axis 16 and a second roller 18 arranged to rotate about a second axis 20. The first and second axes 16, 20 are substantially parallel. A web path is provided through the dispensing unit 4 and a portion of the web path consists of a web passage defined between the first roller 14 and the second roller 18. The tail 12 of the continuous web material extends along the web path in FIG. 1. The first roller 14 is displaceable, as illustrated by arrow 22, between at least a first position in which the first roller 14 is illustrated with a continuous line, and a second position in which the first roller 14' is illustrated with a broken line. A first distance is defined between the first roller 14 and the second roller 18 when the first roller 14 is arranged in the first position, and a second distance is defined between the first roller 14 and the second roller 18 when the first roller 14' is arranged in the second position. The web path extends from the dispensing end 10 of the housing 6 and through the dispensing unit 4.

The dispenser 2 and the dispensing unit 4 are adapted for dispensing of continuous web material when the first roller 14 is in each of the first position and in the second position. The first distance is smaller than the second distance. Thus, dispensing of perforated continuous web material may suitably be performed when the first roller 14 is in the first position. When the first roller 14 is in the first position, the web passage has a width forming a nip. When a user pulls on the tail 12, frictional forces applied to the web material by the first and second rollers 14 will cause a relevant perforation to break. Dispensing of non-perforated continuous web material may suitably be performed when the first roller 14 is in the second position. For the latter, the dispensing unit 4 comprises a tear-off arrangement 24 arranged downstream of the web passage. The tear-off arrangement 24 comprises e.g. a serrated edge. A user thus, may separate a sheet of non-perforated web material from the continuous web material by means of pulling the web material against the tear-off arrangement 24.

The first roller 14 may be arranged to guide the web path clear of the tear-off arrangement 24 in the first position (continuous line). In the second position (broken line), the first roller 14' may be arranged to expose the web path to the tear-off arrangement 24. In this manner a user may be able to use the tear-off arrangement 24 for non-perforated web material whereas perforated web material is held clear of the tear-off arrangement 24.

The continuous web material has a first width 25, which corresponds to the width of the roll 8. The web passage has a second width in a direction parallel with the first axis 16. The second width is smaller than the first width.

Figure 2:
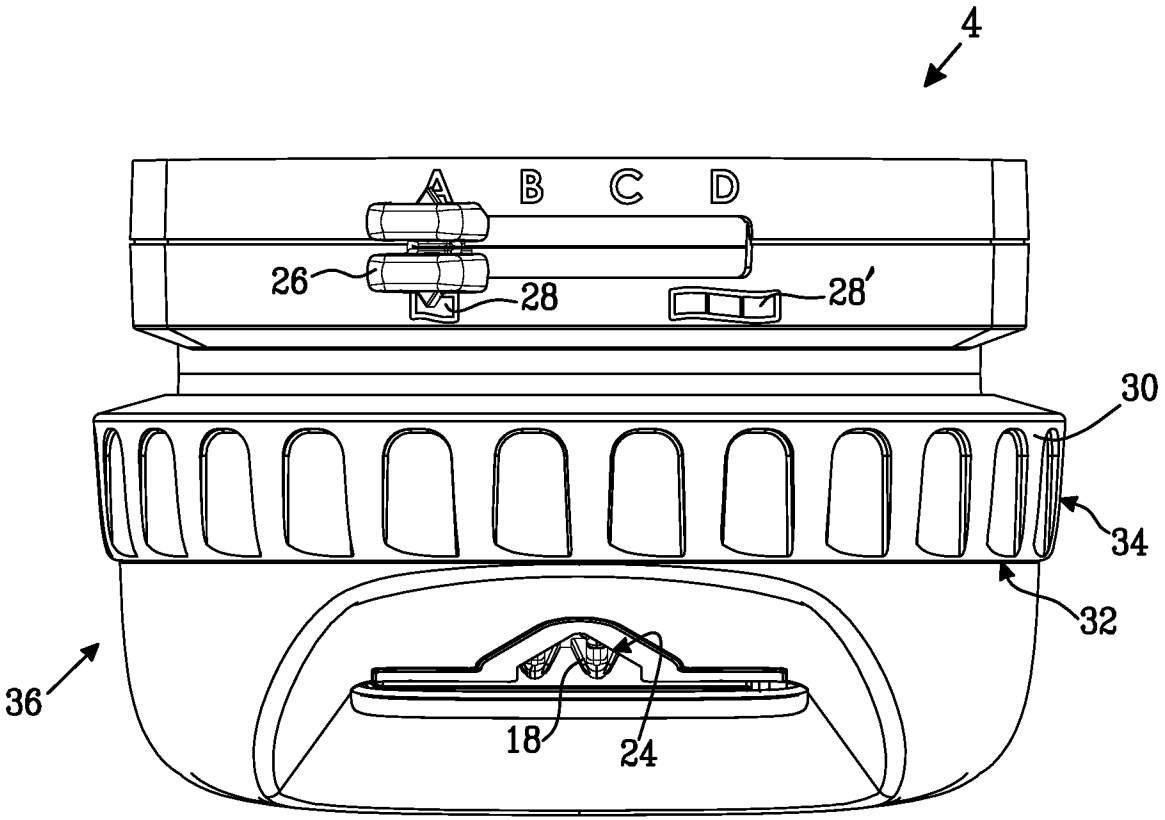
FIG. 2 illustrates a dispensing unit adapted for dispensing of continuous web material according to embodiments.

FIG. 2 illustrates a dispensing unit 4 adapted for dispensing of continuous web material according to embodiments. The dispensing unit 4 may be permanently or removably attached to a housing of a relevant dispenser, which housing supports a roll of continuous web material. The dispensing unit 4 comprises a first roller (not visible) and a second roller 18. A web path for the continuous web material extends through the dispensing unit 4 and a portion of the web path consists of a web passage defined between the first roller and the second roller 18. The first roller is displaceable between a first position and a second position. In the second position the first roller is at a greater distance from the second roller 18 than in the first position. The dispensing unit 4 comprises a tear-off arrangement 24 having a V-shaped opening. The first roller is arranged to guide the web path clear of the tear-off arrangement 24 in the first position. In the second position, the first roller is arranged in the dispensing unit 4 such that the web path is exposed to the tear-off arrangement 24.

In FIG. 2 the dispensing unit 4 is illustrated with the first roller arranged in the second position. Thus, the dispensing unit 4 is set for dispensing of non-perforated continuous web material. A user pulling the web material into a pointed portion of the V-shaped opening of the tear-off arrangement 24 thus, may separate a sheet of non-perforated web material from the continuous web material.

The dispensing unit 4 comprises a position controller 26 being movable between a first setting and a second setting. By means of the position controller 26 the first roller is positioned in one of the first and second positions. The dispensing unit 4 comprises a visual indicator 28, 28' at an outer surface of the dispensing unit. The position controller 26 is arranged to interact with the visual indicator 28, 28' to indicate the first position and the second position, respectively. In FIG. 2, the visual indicator 28, 28' shows a non-perforated web material 28 and a perforated web material 28'. Accordingly, the position controller 26 is illustrated in the second setting, in which the first roller is in the second position and the dispensing unit 4 is set for dispensing of non-perforated web material.

The dispensing unit 4 comprises a drive mechanism for feeding web material from a roll of web material through the web passage. The drive mechanism engages with at least one of the first roller and the second roller 18. The drive mechanism comprises a feeding ring 30 rotatably suspended in the dispensing unit 4. The feeding ring 30 extends around the web path. A wall portion 32 of the dispensing unit 4 may comprise a seat for rotatably supporting the feeding ring 30.

An outer circumferential surface 34 of the feeding ring 30 forms an outer surface portion of the dispensing unit 4. The dispensing unit 4 comprises a circular cylindrical portion 36 and the feeding ring 30 forms at least part of the circular cylindrical portion 36. The feeding ring 30 is arranged to be manually actuated. The feeding ring 30 may be rotated by a user in order to affect the drive mechanism and the first roller 14 and/or second roller 18 to advance the web material, e.g. if a tail of the web material extends into the web passage between the first and second rollers 14, 18 but is not reachable from an outside of the dispensing unit 4. Such advancing may be required if a perforation breaks within the dispensing unit 4, or when replenishing a relevant dispenser with a roll of web material. The first roller 14 has to be in its first position, in which the distance between the first and second rollers 14, 18 is such that a frictional force between the web material and the first and second roller 14, 18 is sufficient to advance the web material from a roll of web material in a relevant dispenser.

Figure 3:
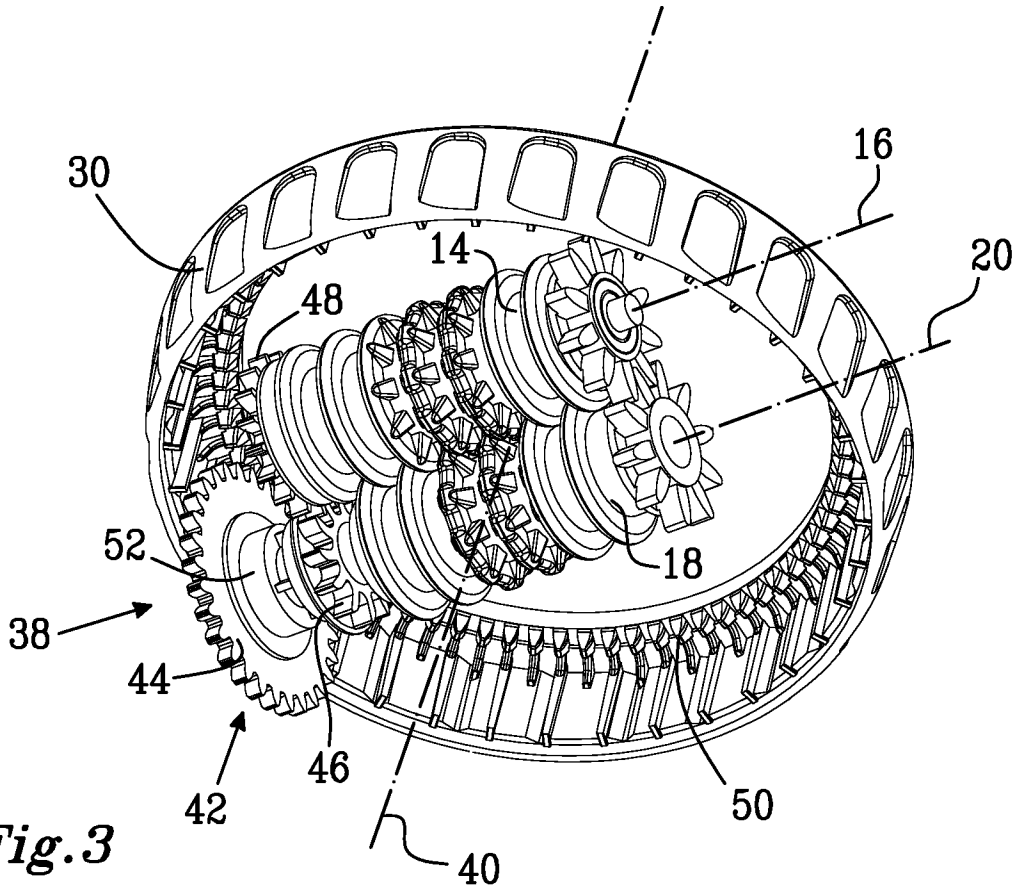
FIG. 3 illustrates the drive mechanism and the first and second rollers of the dispensing unit illustrated in FIG. 2.

FIG. 3 illustrates the drive mechanism 38 and the first and second rollers 14, 18 of the dispensing unit 4 illustrated in FIG. 2. The drive mechanism 38 comprises the feeding ring 30. The feeding ring 30 is arranged to rotate about a third axis 40. The third axis 40 extends substantially perpendicularly to a first axis 16 of the first roller 14 and to a second axis 20 of the second roller 18.

The drive mechanism 38 engages with the first roller 14. Accordingly a rotation of the feeding ring 30 about the third axis is translated into a rotation of the first roller 14. The drive mechanism 38, besides the feeding ring 30, further comprises a transmission 42 arranged between the feeding ring 30 and the first roller 14. The transmission 42 comprises a first gearing with a number of cog wheels 44, 46, and 48 engaging with the feeding ring 30 and each other. The feeding ring 30 comprises a portion forming a toothed wheel internal gear 50, which engages with a first cog wheel 44 of the first gearing of the transmission 42. The first cog wheel 44 is connected via an axle 52 to a second cog wheel 46. The second cog wheel 46 engages with a third cog wheel 48 connected to the first roller 14 when the first roller 14 is in the first position, as illustrated in FIG. 3. When the first roller 14 is in its second position, the second and third cog wheels 46, 48 do not engage with each other. Accordingly, if the feeding ring 30 is rotated when the first roller is in the second position, the first roller 14 is not rotated. It is to be noted in FIG. 3, that the first and second cog wheels 44, 46 as well as the axle 52 are separate from the second roller 18.

A second gearing comprising a fourth and a fifth cog wheel 54, 56 are connected to the first roller 14 and the second roller 18. Thus, a rotation of the first roller 14 is transferred to the second roller 18 only when the first roller 14 is in its first position. Accordingly, both the first roller 14 and the second roller 18 are rotated when a user rotates the feeding ring 30.

Figure 4:
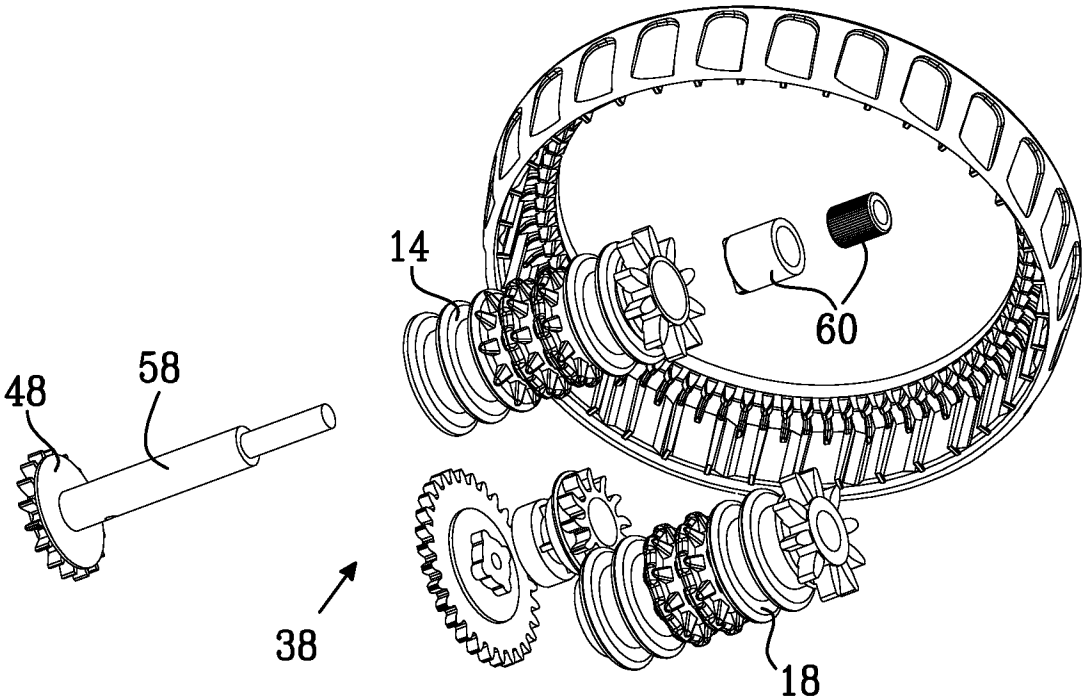
FIG. 4 illustrates an exploded diagram of the drive mechanism and the first and second rollers illustrated in FIG. 3.

FIG. 4 illustrates an exploded diagram of the drive mechanism 38 and the first and second rollers 14, 18 illustrated in FIG. 3. The third cog wheel 48 is connected to the first roller 14 via a drive shaft 58 and a one-way bearing 60 arranged between the drive shaft 58 and the first roller 14. Put differently, the one-way bearing 60 is arranged between the drive shaft 58, which drive shaft 58 forms part of the drive mechanism 38, and the first roller 14. Accordingly, a rotation of the feeding ring 30, in a direction which advances web material from a relevant dispenser is transferred to the first roller 14 but a rotation of the first roller 14, caused by web material being dispensed along the web path, is not transferred via the first roller 14 to the feeding ring 30. Also, due to the one-way bearing 60, a rotation of the feeding ring 30 in an opposite direction does not affect the first roller 14. Thus, accidental reverse feeding of the web material back into the dispensing unit and a relevant dispenser may be avoided.

Figure 5:
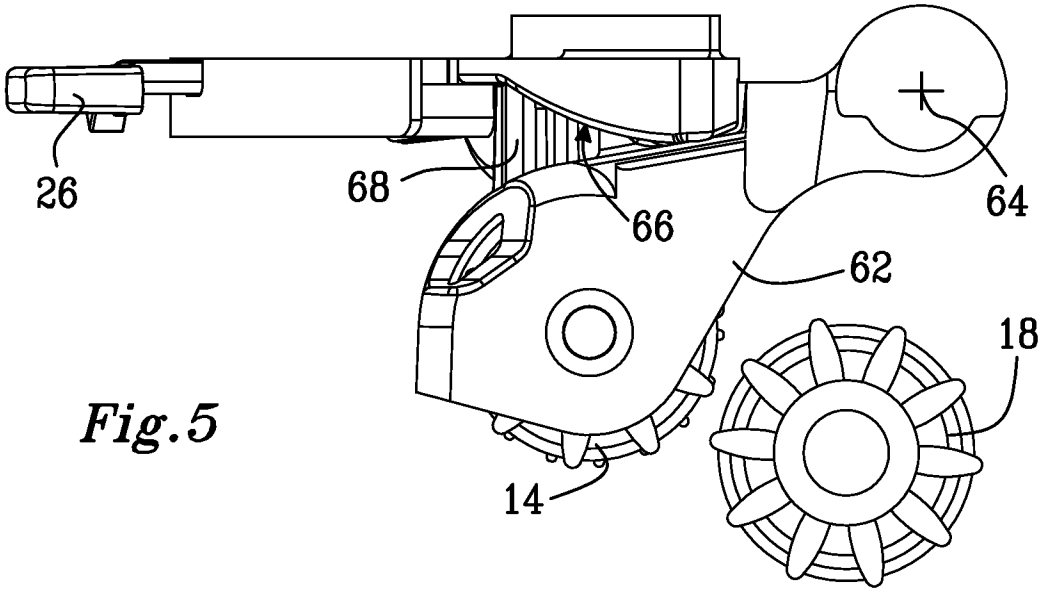
FIG. 5 illustrates parts of the dispensing unit illustrated in FIG. 2.

FIG. 5 illustrates parts of the dispensing unit illustrated in FIG. 2. The first roller 14 is suspended in a cradle 62. The cradle 62 is movably arranged in the dispensing unit. More specifically, the cradle 62 is pivotably suspended and thus, arranged to pivot about a cradle axis 64. The first roller 14 is positioned in its second position.

The position controller 26 comprises a cam surface 66 and the cradle 62 comprises a cam follower 68. As illustrated in FIG. 5, the position controller 26 is positioned in its second setting, in which the cam follower 68 abuts against the cam surface 66 in a position farther away from the second roller 18 than when the first roller 14 is in the first position. Thus, the cradle 62 is pivoted about the cradle axis 64 in a direction away from the second roller 18 in comparison with the first position of the first roller 14 illustrated with a continuous line in FIG. 1.

Figure 6:
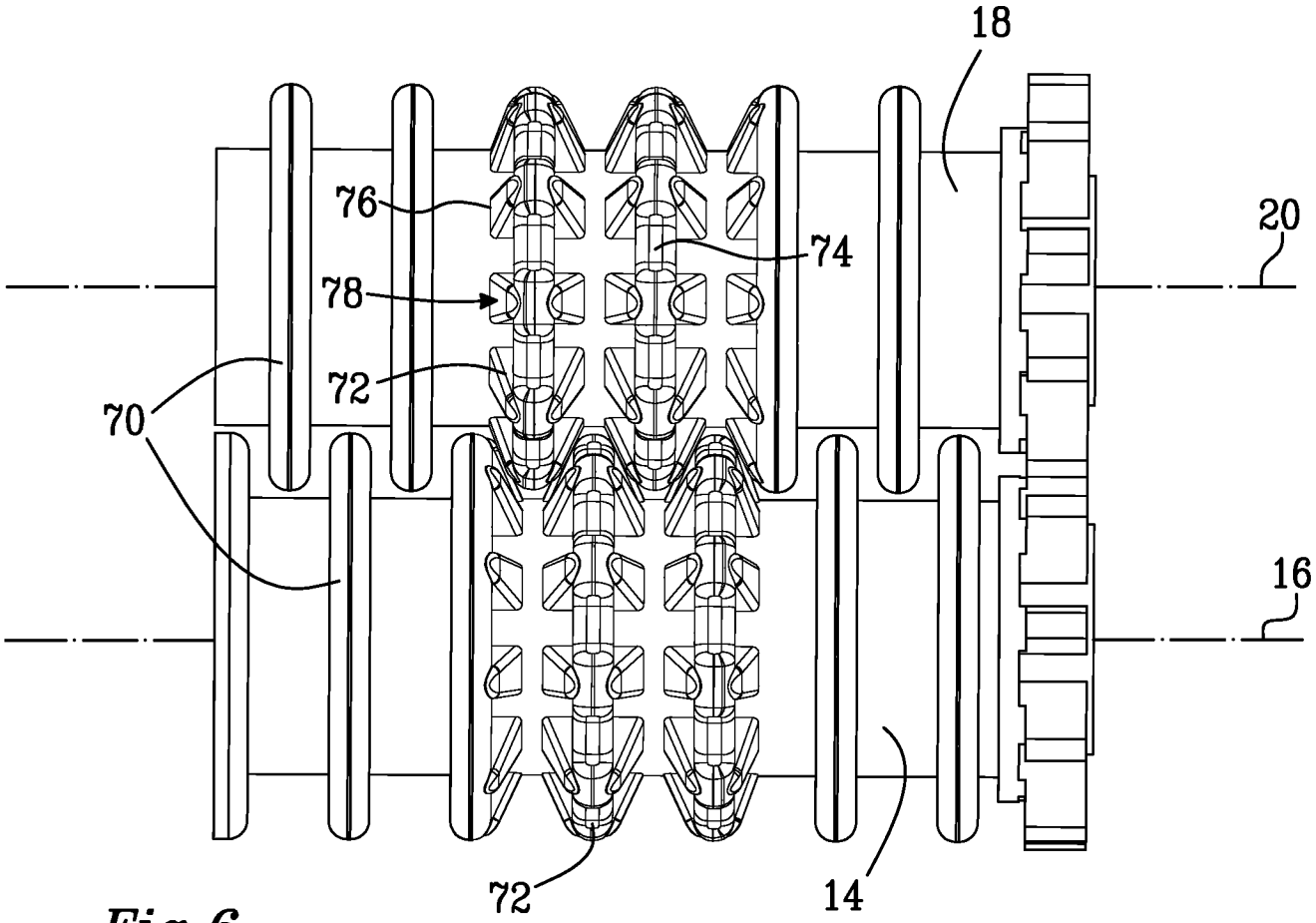
FIG. 6 illustrates first and second rollers of a dispensing unit according to embodiments.

FIG. 6 illustrates first and second rollers 14, 18 of a dispensing unit according to embodiments. The first roller 14 and the second roller 18 comprise disc-shaped elements 70, 72 arranged at a distance from each other along first and second axes 16, 20 of the first and second rollers 14, 18, respectively. The first roller 14 is arranged in a first position, in which the disc-shaped elements 70, 72 of the first roller 14 overlap the disc-shaped elements 70, 72 of the second roller 18 and form an undulated web passage between the first and second rollers 14, 18. Accordingly, the disc-shaped elements 70, 72 form large diameter longitudinal sections of the first and second rollers 14, 18 between which small diameter longitudinal sections are arranged. Small diameter longitudinal sections of the respective rollers 14, 18 are arranged opposite to large diameter longitudinal section. At least one of the disc-shaped elements 72 of each roller 14, 18, seen in a circumferential direction, comprises narrow portions 74 and wide portions 76. In this manner the at least one disc-shaped element 72 of each roller 14, 18 forms a cog wheel having axial cogs 78. The axial cogs 78 of the disc-shaped elements 72 of the rollers 14, 18 define part of the web passage.

According to embodiments, the disc-shaped elements 70, 72 of the first roller 14 and the second roller 18 may overlap each other 1.5-6 mm in the first position of the first roller 14. The overlap is seen in a direction along the first and second axes 16, 20. It is to be understood that there is a clearance, seen perpendicularly to the first axis 16, between the disc-shaped elements 70, 72 of the first roller 14 and the second roller 18, and between the disc-shaped elements 70, 72 of the second roller 18 and the first roller 14. The clearance may be within the same range as the overlap. Purely as an example, the following measurements may be mentioned: The diameters of the rollers 14, 18 may be 20 mm, or may be within the interval of 12-40 mm. The diameters of the disc-shaped elements 70, 72 may be 30 mm, or may be within the interval of 20-50 mm. The width of the disc-shaped elements 34, 36 may be 3 mm, or within the interval of 2-5 mm. The cogs 78 may be approximately 4 mm wide, or within the interval of 2-5 mm, at their bases in the circumferential direction. The distance between the cogs 78 may be approximately 5 mm, or within the interval of 3-7 mm, at their bases in the circumferential direction. The cogs 78 may be approximately 6 mm wide, or within the interval of 4-8 mm, at their bases in the axial direction. The width of the undulated web passage between the disc-shaped elements 70 may be 1.4 mm, or within the interval of 0.5-5 mm.

The second roller 18 may be suspended in a second cradle, not shown. The distance between the first and second rollers 14, 18 and the overlap between the disc-shaped elements 70, 72, when the first roller 14 is in the first position, may in such case be finely adjusted by positioning of the second cradle. Provided purely as an example, the overlap between the disc-shaped elements 70, 72 of the first and second rollers 14, 18 may be 3.5 mm in one position of the second roller 18, and the overlap may be 2.2 mm in different position of the second roller 18.

Example embodiments described above may be combined as understood by a person skilled in the art. Although various aspects have been described with reference to example embodiments, many different alterations, modifications and the like will become apparent for those skilled in the art. The first roller 14 may for instance be positioned in only one position in the dispensing unit 4.

Therefore, it is to be understood that the foregoing is illustrative of various example embodiments and the present disclosure is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A dispensing unit for a dispenser being adapted for the use with continuous web material, the dispensing unit comprising a first roller arranged to rotate about a first axis and a second roller arranged to rotate about a second axis, the first and second axes being substantially parallel, wherein a web path is provided through the dispensing unit and a portion of the web path consists of a web passage defined between the first roller and the second roller, and wherein a drive mechanism engages with at least one of the first roller and the second roller for feeding the web material through the web passage, and wherein the drive mechanism comprises a feeding ring rotatably mounted in the dispensing unit, the feeding ring encircling the web path.

2. The dispensing unit according to claim 1, wherein the dispensing unit comprises a circular cylindrical portion and the feeding ring forms at least part of the circular cylindrical portion.

3. The dispensing unit according to claim 1, wherein the feeding ring is arranged to be manually actuated.

4. The dispensing unit according to claim 1, wherein the drive mechanism engages with the first roller.

5. The dispensing unit according to claim 4, wherein a one-way bearing is arranged between a drive shaft of the drive mechanism and the first roller.

6. The dispensing unit according to claim 4, wherein the drive mechanism comprises a transmission arranged between the feeding ring and the first roller.

7. The dispensing unit according to claim 6, wherein the transmission comprises a first gearing.

8. The dispensing unit according to claim 7, wherein a second gearing is connected to the first roller and the second roller to transfer a rotation from the first roller to the second roller.

9. The dispensing unit according to claim 1, wherein the first roller is mounted in a cradle, the cradle being movably arranged in the dispensing unit to displace the first roller from a first position to a second position, wherein the first position is closer to the second roller than the second position.

10. The dispensing unit according to claim 9, wherein the first roller and the second roller comprise disc-shaped elements and the disc-shaped elements of the first and second rollers overlap each other 1.5-6 mm in the first position of the first roller.

11. The dispensing unit according to claim 1, wherein the first roller and/or the second roller comprises disc-shaped elements arranged at a distance from each other along the first axis of the first roller and/or the second axis of the second roller.

12. The dispensing unit according to claim 11, wherein at least one of the disc-shaped elements, seen in a circumferential direction, comprises narrow portions and wide portions.

13. A dispenser comprising a housing adapted to receive and support a roll of continuous web material, wherein the housing has a dispensing end, and the dispenser comprises a dispensing unit according to claim 1 attached to the housing at the dispensing end, wherein the web path extends from the dispensing end of the housing and through the dispensing unit.

14. The dispenser according to claim 13, wherein the housing is adapted to receive a centre feed roll of continuous web material.

15. The dispensing unit according to claim 1, wherein the feeding ring comprises a toothed gear on an inner surface of the feeding ring.

16. A dispensing unit for a dispenser being adapted for the use with continuous web material, the dispensing unit comprising a first roller arranged to rotate about a first axis and a second roller arranged to rotate about a second axis, the first and second axes being substantially parallel, wherein a web path is provided through the dispensing unit and a portion of the web path consists of a web passage defined between the first roller and the second roller, and wherein a drive mechanism engages with at least one of the first roller and the second roller for feeding the web material through the web passage, and wherein the drive mechanism comprises a feeding ring rotatably mounted in the dispensing unit, the feeding ring extending around the web path; and wherein the feeding ring is arranged to rotate about a third axis, and the third axis extends substantially perpendicularly to the first axis and the second axis.

17. A dispensing unit for a dispenser being adapted for the use with continuous web material, the dispensing unit comprising a first roller arranged to rotate about a first axis and a second roller arranged to rotate about a second axis, the first and second axes being substantially parallel, wherein a web path is provided through the dispensing unit and a portion of the web path consists of a web passage defined between the first roller and the second roller, and wherein a drive mechanism engages with at least one of the first roller and the second roller for feeding the web material through the web passage, and wherein the drive mechanism comprises a feeding ring rotatably mounted in the dispensing unit, the feeding ring extending around the web path; and wherein an outer circumferential surface of the feeding ring forms an outer surface portion of the dispensing unit.

* * * * *